US005741590A

United States Patent [19]

Kobsa et al.

[11] Patent Number: 5,741,590

[45] Date of Patent: Apr. 21, 1998

[54] IRIDESCENT FABRICS

[75] Inventors: Henry Kobsa, Greenville, Del.; Barry Rubin, Glen Mills, Pa.; Stephen Marshall Shearer; James Edmond Van Trump, both of Wilmington, Del.; Walter P. Warren, Newark, Del.

[73] Assignee: E. I. du Pont de Nemours and Company, Wilmington, Del.

[21] Appl. No.: 528,962

[22] Filed: Sep. 15, 1995

Related U.S. Application Data

[63] Continuation of Ser. No. 128,491, Sep. 28, 1993, abandoned.

[51] Int. Cl.[6] ..... D06P 1/00; D06P 3/82; D06P 3/854; D01F 8/14

[52] U.S. Cl. ..... 428/373; 428/397; 428/401; 428/913; 412/192; 412/200; 412/309; 412/311

[58] Field of Search ..... 428/373, 397, 428/401, 913; 442/192, 200, 311, 309

[56] References Cited

U.S. PATENT DOCUMENTS

| | | | |
|---|---|---|---|
| 3,716,330 | 2/1973 | Kitamura et al. | 8/169 |
| 4,059,949 | 11/1977 | Lee | 57/140 |
| 4,075,378 | 2/1978 | Anton et al. | 428/97 |
| 4,623,602 | 11/1986 | Bakker et al. | 430/106 |
| 5,252,396 | 10/1993 | Fukui et al. | 428/373 |

FOREIGN PATENT DOCUMENTS

| | | |
|---|---|---|
| 47-31368 | 8/1972 | Japan . |
| 491650 | of 1974 | Japan . |
| 4-272221 | of 1992 | Japan . |
| 1476545 | of 1974 | United Kingdom . |
| 95/09264 | 4/1995 | WIPO . |

OTHER PUBLICATIONS

The English translation of JP47–31368, Aug. 1972.

Man–made fibres by Mancrieff, John Wiley & Sons, New York 1995, p. 29.

Understanding Fabrics, p. 115 and Title Page, Fairchild Publications, New York, 1982.

The Color Compendium, p. 175 and Title Page, Van Nostrand Reinhold, New York, 1990.

*Primary Examiner*—Kathleen Choi

[57] ABSTRACT

An iridescent effect is achieved in satin weave filling-faced fabric using sheath-core filaments wherein the core is dyed to a color that is different from that of the sheath.

18 Claims, No Drawings

IRIDESCENT FABRICS

The present invention is a continuation of application Ser. No. 08/128,491, filed Sep. 28, 1993, now abandoned.

BACKGROUND OF THE INVENTION

There is demand for fabrics that present unusual and interesting styling effects. This invention concerns a novel fabric which exhibits a plurality of colors depending on the angle at which it is viewed.

SUMMARY OF THE INVENTION

The present invention provides iridescent fabrics in which the face yarn lie in predominantly straight and parallel sections and consists essentially of continuous, round concentric, sheath-core polymeric filaments wherein the core constitutes from 10 to 35 volume percent of the filament and is dyed to a color that is different from that of the sheath. The novel sheath-core filaments are also part of this invention.

DETAILED DESCRIPTION OF THE INVENTION

Woven fabrics that have predominantly straight and parallel yarn sections on the fabric face particularly those having fill yarns which float over at least four warp yams show the iridescent two-color effect provided by this invention. Preferred are satin weave (filling-faced) fabrics which have long floats of filling yarn across the face or exposed surface of the fabric. Other such woven fabrics are long-float basket weaves and twills. Processes other than weaving may yield fabrics of similar optical effects such as stitch-bonded fabrics where the laid-in yarns can be held straight and parallel and even warp knits of "Delaware Stitch" construction where a surface bar jumps over three or more needles to form straight yarn sections on the surface. In accordance with the present invention it has been found that if the yarns which lie on the surface of such fabrics are continuous, round, concentric, sheath-core filaments in which the core constitutes from 10 to 35, and preferably 15 to 30 volume percent of the filament and is dyed a different color from the sheath, the fabric will exhibit interesting visual characteristics. In particular, because of undulations in the fabric, as occur naturally when the fabric is in the form of a garment, light will strike the fabric at different angles of incidence. To the viewer, the fabric will exhibit at least two colors, and depending on the difference between the colors, subtle or substantial effects may be obtained.

In order to achieve the desired effect of enhanced iridescence, it is important that the polymers forming the sheath and core respectively have substantially different receptivities for at least one class of dyes, e.g., acid, basic or disperse dyes. This enables both the sheath and the core polymers to be dyed different colors. The polymer combinations selected for use in the invention are polyester and/or polyamide. For example, the sheath may be acid dyeable nylon and the core basic dyeable nylon; the sheath may be polyethylene terephthalate and the core basic dyeable polyethylene terephthalate. The sheath may be basic-dyeable polyethylene terephthalate and the core acid dyeable nylon. Other combinations will be apparent to those skilled in the art. For specific dyeable components one may refer to British Patent Specification 1,476,545, Jun. 16, 1977.

The size of the core relative to the sheath is another consideration. As light strikes a round fiber, it is concentrated within the fiber at a depth depending upon the angle at which the rays enter with respect to the fiber axis. At a 90° angle of incidence, the light has been calculated to be concentrated at a level about 63% of the distance from the longitudinal axis of the fiber to the fiber surface. At lower entry angles, the concentration of light will be closer to the axis. In accordance with the present invention, the core volume upper limit is about 35% and preferably 30% since it insures that the concentration of light at a 90° angle of incidence angle is within the sheath while at low angles of incidence, the concentration of light will be in the core. The location of light concentration will vary from sheath to core as the fabric undulates, and the angle of incidence with respect to the fiber axis changes. Since the core and sheath polymers are dyed to different colors, the color that is seen will also vary. Below about 10% core volume, this phenomenon is not readily observed.

The production of sheath-core filaments is well-known. Spinneret pack assemblies suitable for spinning the sheath-core filaments are disclosed in U.S. Pat. No. 2,936,482 to Killian.

Procedures for dyeing the filaments in yarn or fabric form are well-known in the art. For example, when the sheath and core polymers are selected from acid-dyeable nylon and basic-dyeable nylon or basic-dyeable polyester, the cationic or basic dye is preferably added first and allowed to exhaust prior to addition of the acid dye, regardless of whether the basic-dyeable polymer is in the sheath or core. This prevents staining of the acid-dyeable nylon with the cationic dye as well as any precipitation problems that may occur when acid and cationic dyes are present in the dye bath. If one or both of the sheath and core components are polyester, it may be necessary to use a chemical carrier during dyeing in order to swell the polyester. Alternatively, the dyeing of sheath/core fibers where the sheath and/or core are polyester may be conducted at elevated temperature using pressure dyeing. For example, temperatures of 250°–265° F. (121°–129° C.) are useful when dyeing polyester fibers.

The satin weave fabrics of the invention employ the sheath-core yarns as the filling-face. The warp yarns may be polyester or other yarns since they are not visible when a garment of the fabric is worn.

The following examples illustrate the present invention and are not intended as limiting.

EXAMPLES

Example 1

This example demonstrates spinning and dyeing of sheath-core fibers comprising an acid-dyeable nylon 66 sheath and a basic-dyeable nylon 66 core. A fluorescent cationic dye was used to dye the core.

Thirty-four filament, 80 denier yarns were prepared by melt-spinning a dead-bright acid-dyeable homopolymer nylon 66 flake and a dead-bright basic-dyeable nylon 66 flake through a 34 hole, concentric, sheath/core spinneret pack of the land metering type similar to that shown in Killian U.S. Pat. No. 2,936,482, that was fed by twin screw-melters. The acid-dyeable sheath polymer flake had a relative viscosity of 40, an amine end-group level of 54 equivalents/$10^6$ grams of polymer, and a carboxyl end-group level of 65 equivalents/$10^6$ grams of polymer. The basic-dyeable core polymer flake was a 5-(sodiosulfo)isophthalic acid copolymer of polyhexamethyleneadipamide with a relative viscosity of 42, an amine end-group level of 40 equivalents/$10^6$ grams of polymer, a carboxyl end-group level of 90 equivalents/$10^6$ grams of polymer, and a sulfonate level of 77 equivalents/$10^6$ grams of polymer.

The molten polymers were filtered through 20/30 mesh sieved, acid washed silica sand and spun at 434 m/min at a pack temperature of 285° C. and a pack pressure of 1200 psi. The amount of polymer in the sheath and the core was regulated by adjusting the relative pump speed for each polymer being fed to the spinneret. Filaments were spun with various volume percent basic-dyeable core. The filaments were hot-pin drawn at 1200 m/min at 100° C., relaxed in a hot chest (1160 m/min) at a temperature of 125° C., and wound up at 1150 m/min. An alkoxylated fatty acid finish was applied prior to wind up.

The yarns were knitted into tube form prior to dyeing. In preparation for dyeing, the knitted samples were scoured in a Labomat Model BFA 16 benchtop dyer (Warner-Mathis, Zurich, Switzerland). A knitted sample (5g) was added to an aqueous bath (200 cc) at 110° F. (43° C.) containing, based on weight of fiber, 2% Merpol LF-H alcohol/ethylene oxide-propylene oxide nonionic surfactant and 2% of tetrasodium pyrophosphate. The bath temperature was raised to 200° F. (93° C.) at 3° F./min (1.67° C./min), held at that temperature for 30 minutes and then cooled to 170° F. (77° C.). The sample was rinsed well with water and dried.

The scoured sample was added to an aqueous bath (200 cc) at 80° F. (27° C.). An antiprecipitant/wetting agent (Alkanol ACN) and monosodium phosphate were added to the bath. The pH of the bath was adjusted to 6.0 using acetic acid and tetrasodium pyrophosphate solutions. A fluorescent cationic dye, Sevron Brilliant Red 4G was added at 0.8% based on weight of fiber (16 cc of a 0.25 wt. percent dye stock solution). After 10 minutes, the acid dye, Tectilon Blue 4RV (200) was added at 0.4% based on weight of fiber. The bath temperature was increased to 212° F. (100° C.) at a rate of 3° F./minute (1.67° C./min) and held at the set temperature for 60 minutes. The bath was then cooled to 170° F. (77° C.) and the sample washed with water until the rinse water was clear.

After air-drying, the dyed fabric was de-knitted and the yarn wound onto 4.5×2.75 in. (11.4×7.0 cm) black mirror cards for evaluation. The mirror cards were wound by hand with the yarn under tension to form a 1.5 in. (3.8 cm) strip of yarn centered along the 4.5 in. (11.4 cm) length of the card, with each succeeding wrap covering the preceding wrap for a total of 5 wraps.

The iridescent effect was evaluated by visually examining the wound mirror card samples. The samples were viewed in sunlight at an angle normal to the surface and then were slowly turned away from the viewer and the shift in color examined as a function of viewing angle. The sheath/core samples were purple when viewed normal to the surface. A marked change in color from purple to orange/red was observed as some samples were rotated to lower viewing angles. The effect was more consistent and greatest for from 19.1 to 28.7% core. Sample 7 of the Table below showed little effect while none was noted in Samples 8 and 9.

The dyed yarns were sectioned and the cross-sections of seven filaments from each yarn sample measured from photographs (several hundred enlargement). The core percent values obtained are shown in the table below.

TABLE 1

| Sample | % Core |
|---|---|
| 1 | 24.4 |
| 2 | 19.1 |
| 3 | 12.8 |
| 4 | 6.4 |
| 5 | 28.7 |
| 6 | 34.2 |
| 7 | 40.1 |
| 8 | 41.3 |
| 9 | 61.0 |

Example 2

This example demonstrates dyeing of the yarns of Example 1 where the core is dyed with a non-fluorescent dye.

Samples of the yarns of Example 1 were dyed using the same scouring/dyeing procedures except that 1.0% based on weight of fiber of Sevron Red GBL, a non-fluorescent dye, was substituted for the Sevron Brilliant Red 4G fluorescent dye.

The iridescent behavior observed upon visual examination of card wound samples was similar to that observed for the samples of Example 1, although the iridescent effect was less dramatic.

Example 3

This example demonstrates spinning and dyeing of sheath-core fibers comprising an acid-dyeable nylon 66 sheath and a basic-dyeable polyester core. A fluorescent cationic dye was used to dye the core.

The filaments were spun using the same nylon 66 homopolymer in the sheath as was used in Example 1. The core polymer was a polyethylene terephthalate copolymer containing 2 wt. percent of the dimethyl ester of 5-sulfoisophthalic acid. Sheath-core filaments were spun from a 17-hole spinneret with pump setting varied to obtain filaments with various volume percent basic-dyeable core. The yarns were low-speed spun at 300 meters/min. and 285° C., drawn 2.5× at 740 meters/min. through a 252° C. steam jet, relaxed at 720 meters/min. in a 125° C. hot chest, and wound up at 720 meters/min. The yarns obtained were approximately 245 denier.

The yarns were knitted in preparation for dyeing and pre-scoured using the method described in Example 1. The scottred sample was then added to an aqueous bath (200 cc) at 80° F. (27° C.). Merpol LF-H alcohol/ethylene oxide-propylene oxide nonionic surfactant at 0.5 wt. percent on weight of fiber and 12 cc of a 6 g/l solution of sodium sulfate were added to the bath. The pH of the bath was then adjusted to between 5.0–5.5 using an acetic acid solution. After holding 10 minutes, the cationic dye, Sevron Brilliant Red 4G, was added at 0.3% on weight of fiber. The bath temperature was raised to 250° F. (121° C.) at a rate of 3° F./min (1.67° C./min) and run for 1 hour at temperature. The bath was then cooled to 170° F. (77° C.) and the sample rinsed with water until the rinse water was clear. The fabric was then added to an aqueous bath of 200 cc water at 80° F. (27° C.). A wetting agent/retarder (alkanol ND) at 1.0% on weight of fiber and 0.2 wt. percent based on weight of the bath of monosodium phosphate were added to the bath. The pH was adjusted to 6.0 using acetic acid and tetrasodium pyrophosphate solutions. The acid dye, Tectilon Blue 4RV (200) was added at 0.1% on weight of fiber and the temperature of the bath was raised to 212° F. (100° C.) at 3° F./min. (1.67° C./min). The bath was held at temperature for 1 hour and then cooled to 170° F. (77° C.). The sample was washed with water until the rinse water was clear and then dried in air. The dyed fabric was de-knitted and the yarn wound on mirror cards for visual evaluation as described in Example 1.

The dyed yarns were sectioned and measured as in Example 1. The core percent values obtained are shown in the table below. No change in color was observed as Sample 3 was rotated through various viewing angles.

TABLE 2

| Sample | % Core |
|---|---|
| 1 | 29.4 |
| 2 | 23.4 |
| 3 | 46.4 |
| 4 | 35.2 |
| 5 | 12.7 |
| 6 | 17.4 |

Fluorescent dyes are particularly preferred for use in the invention since their effect is quite unusual and pronounced.

Example 4

This example demonstrates weaving of a filling-faced satin fabric using 23% core sheath-core filling yarns and dyeing to obtain an iridescent fabric.

A 5-shaft filling-faced satin fabric was woven using warp yarns of 70 denier (78 dtex) black polyester and sheath-core filling yarns. The filling yarns were spun using the procedure described in Example 1 with 23 vol % core. The vol % core was measured from micrographs as described in Example 1. Two ends of the yarn were plied together with 3 turns/in. (1.2 turns/cm) Z-twist to obtain a 160 denier (180 dtex) filling yarn. The woven fabric was 50 inches in width with 80 ends/inch (33.9 ends/cm) warp yarn and a fill count of 80 ppi (31.5 yarns/cm).

The fabric was scoured followed by heatsetting in an oven for 45 seconds at 350° F. (177° C.). A 30.8 g fabric sample was dyed in a drum dyer using a 5000 cc bath and similar conditions to those described in Example 1, with the amounts of additives and dye adjusted based on the sample weight. The resulting dyed fabric was iridescent, changing color from purple to red due to the undulations in the fabric drape.

We claim:

1. A dyed fabric having predominantly straight and parallel yarn sections on the fabric surface and in which said yarn sections consist essentially of continuous, round concentric sheath-core polymeric filaments wherein the sheath and the cord are polyester and/or polyamide and the core of each of said filaments constitutes from 15 to 30 volume percent of the filament and is dyed a color different from that of the sheath so that said yarn sections exhibit a change in color which is dependent upon a change in the angle at which the fabric is viewed.

2. A fabric according to claim 1 wherein said core is dyed with a fluorescent dye.

3. A fabric according to claim 2 wherein the sheath polymer has a dead bright luster.

4. A fabric according to claim 2 wherein the fluorescent dye is a basic dye.

5. A fabric according to claim 3 wherein the straight and parallel yarn sections are the result of a satin weave.

6. A fabric according to claim 3 which is a warp knit fabric.

7. A fabric according to claim 2 wherein a change in color also is exhibited which is dependent upon a change in angle of incident light and the fabric exhibits a two-color iridescent effect which depends on the colors of the dyed sheath and core polymers.

8. A dyed, round, concentric sheath-core, polymeric filament wherein the sheath and the core are polyester and/or polyamide, the core constitutes from 15 to 30 volume percent of the filament and is dyed a color that is different from that of the sheath so that the filament exhibits a change in color which is dependent upon a change in an angle at which the filament is viewed.

9. A filament of claim 8 wherein the core is dyed with a fluorescent dye.

10. A filament of claim 9 wherein the fluorescent dye is a basic dye.

11. A filament of claim 9 wherein the sheath is dyeable with an acid dye and the core is dyeable with a basic dye.

12. A filament of claim 11 wherein the sheath polymer is an acid dyeable polyamide and the core polymer is a basic dyeable polyamide.

13. A filament of claim 9 wherein the sheath polymer has a dead-bright luster.

14. A filament of claim 9 wherein the color of the sheath becomes less apparent while the color of the core becomes more apparent upon a decrease in the angle of view and/or of the angle of incident light.

15. A yarn consisting essentially of a plurality of continuous filaments of claim 13.

16. A knit or woven fabric comprised of yarns of claim 15.

17. A knit or woven fabric having surface yarns consisting essentially of a yarn of claim 15.

18. A fabric having a surface consisting essentially of:

straight and parallel sections of yarns of dyed, round, concentric sheath-core polymeric filaments wherein the sheath and core polymers are dyed to different colors;

said core constituting from 15 to 30 percent by volume of said filaments and being dyed with a fluorescent dye, and said sheath having a dead-bright luster;

said sheath and core polymers being independently selected from the group consisting of polyester and polyamide polymers;

so that said fabric has the ability to exhibit a change in color as the angle of view and/or of the incident light is changed, with the change in color being related to the colors of the sheath and of the core.

* * * * *